US006302334B1

(12) United States Patent
Restrepo

(10) Patent No.: US 6,302,334 B1
(45) **Date of Patent: *Oct. 16, 2001**

(54) TAR HEATING AND SPRAYING APPARATUS

(75) Inventor: Julián Castaño Restrepo, Antioquia (CO)

(73) Assignee: Politecnico Marco Fidel Suarez, Antioquia (CO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,147

(22) Filed: Aug. 26, 1999

(30) Foreign Application Priority Data

Sep. 3, 1998 (CO) ..... 98-050501

(51) Int. Cl.[7] ..... B05B 1/24
(52) U.S. Cl. ..... 239/139; 239/135
(58) Field of Search ..... 239/135, 136, 239/137, 138, 139

(56) References Cited

U.S. PATENT DOCUMENTS 1,768,485 * 6/1930 Mack .
3,804,079 * 4/1974 Schrader .
3,946,722 * 3/1976 Banahan .
3,990,684 * 11/1976 Seskin .
4,015,588 * 4/1977 Blackwell .
4,033,328 * 7/1977 Lohman et al. .
4,165,192 * 8/1979 Mellen .
4,192,288 * 3/1980 Heller .
4,259,142 * 3/1981 Kortepeter .
4,265,559 * 5/1981 Mellen .
4,553,988 * 11/1985 Shimizu et al. .
5,366,308 * 11/1994 Crispino .
5,832,178 * 11/1998 Schave .
5,974,227 * 10/1999 Schave .

* cited by examiner

*Primary Examiner*—David A. Scherbel
*Assistant Examiner*—Christopher S. Kim
(74) *Attorney, Agent, or Firm*—Nath & Associates PLLC; Gary M. Nath; Harold L. Novick

(57) ABSTRACT

The tar sprayer subject of the present application is conformed by a temperature system, a heating tank, a supply tank, a compressor and a spraygun. It permits the application of tar in industrial waterproofing and road asphalting processes at lesser cost and time, since it may be applied in a continuos manner, it facilitates the use of tar as waterproofer in areas which are difficult to access in the building industry.

2 Claims, 3 Drawing Sheets

TAR HEATING AND SPRAYING APPARATUS

FIELD OF THE INVENTION

The present invention relates to an apparatus that applies hot tar to surfaces.

BACKGROUND OF THE INVENTION

At the present time, tar is applied manually using conventional heating systems to keep it melted and then transport the tar to the desired place for its application.

SUMMARY OF THE INVENTION

The present invention permits the application of tar in industrial waterproofing and road asphalting processes at lesser cost and time because tar is applied in a continuous manner thereby preventing the ambient pollution caused by conventional heating methods. The invention also facilitates the use of tar as a waterproofer in areas which are difficult to access in the building industry.

DETAILED DESCRIPTION OF THE INVENTION

Figure 1:
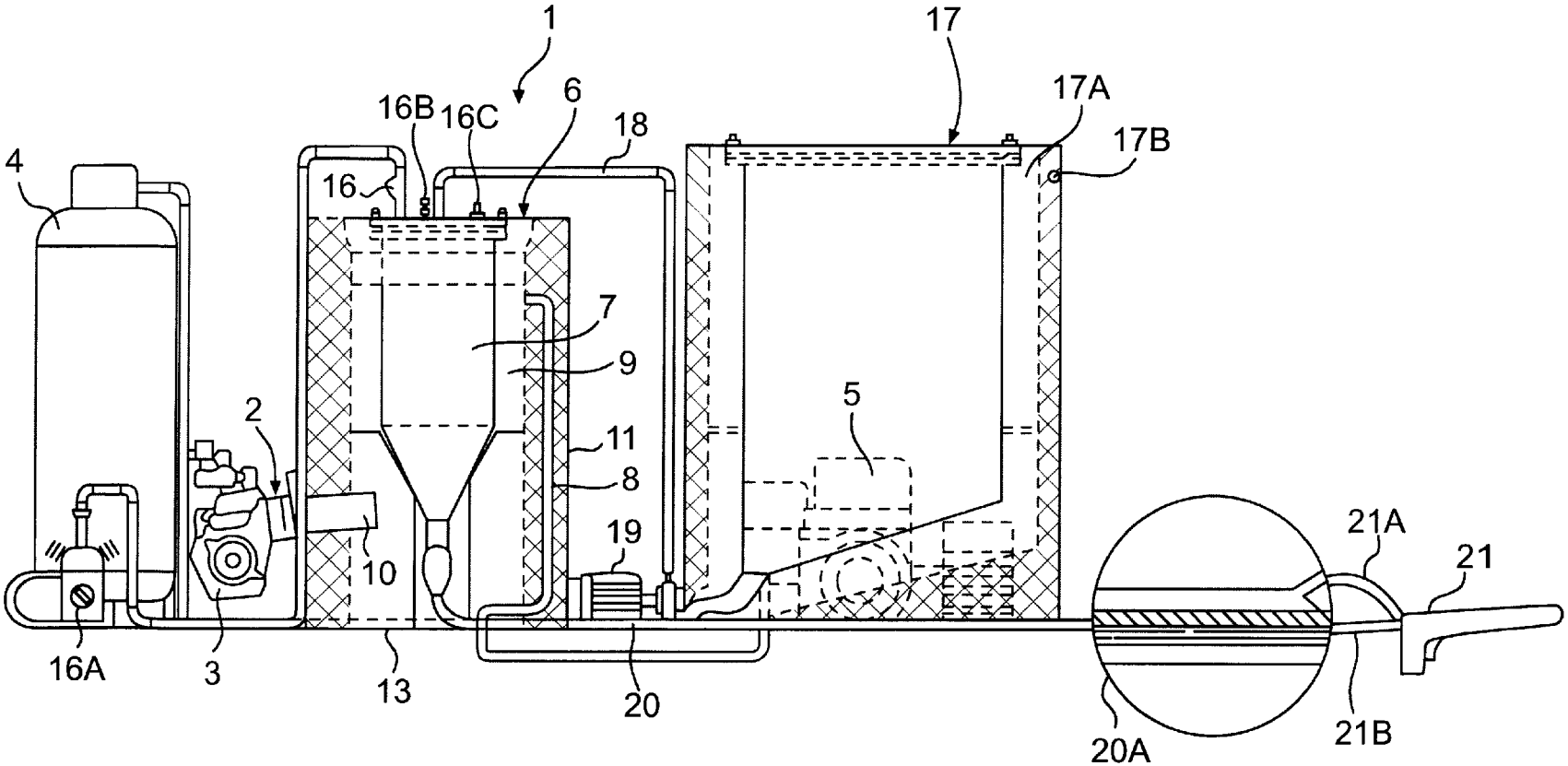
FIG. 1 is a schematic elevational view, partially in cross section, with some parts shown enlarged of a tar heating and spraying apparatus.
Figure 2:
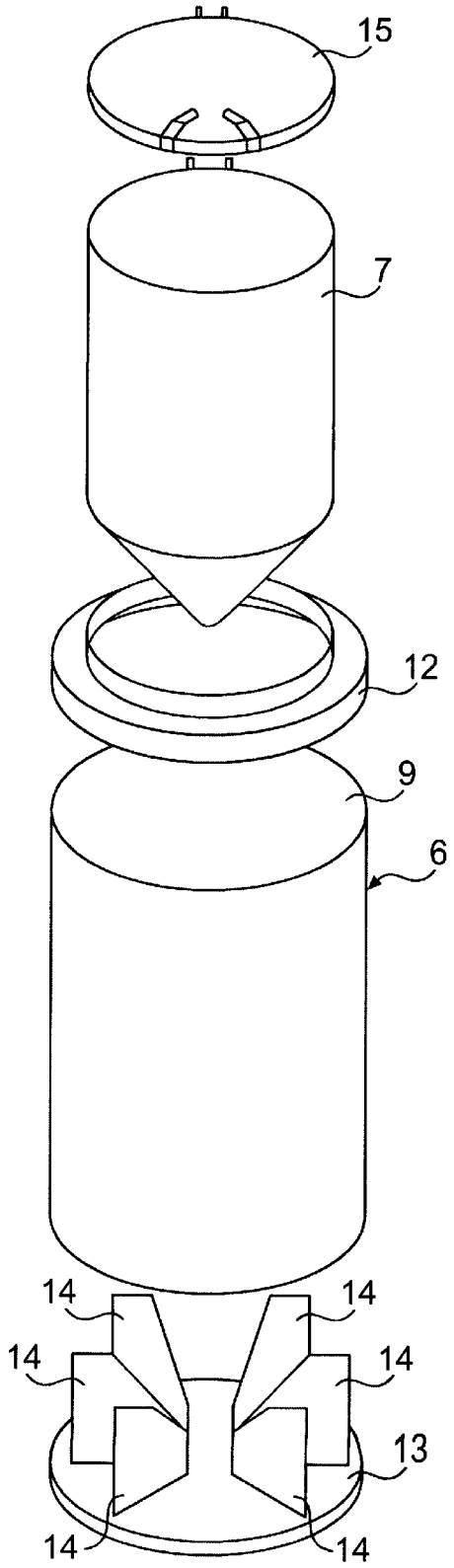
FIG. 2 is a exploded perspective view of the heating tank of FIG. 1.
Figure 3:
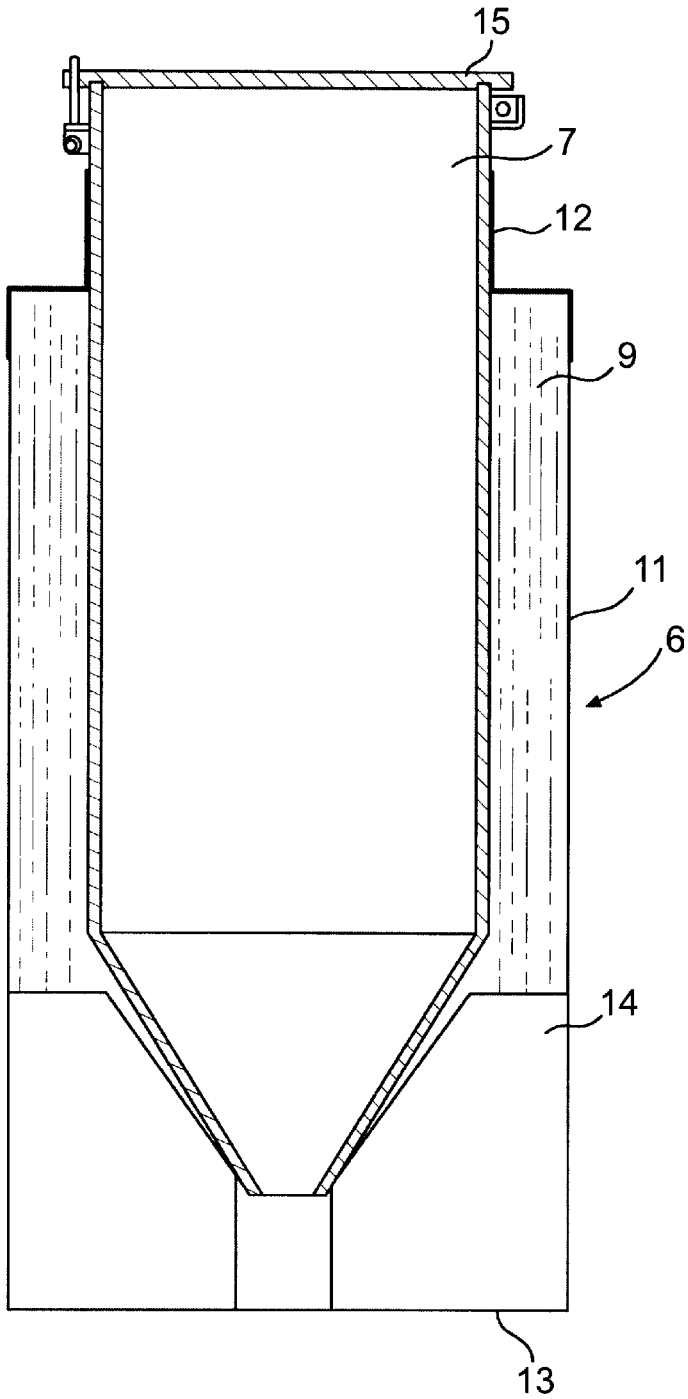
FIG. 3 is a cross sectional view of the heating tank of FIG. 2.

FIG. 1 illustrates a presently preferred embodiment of the present invention that is directed to a tar sprayer (1) which utilizes a temperature system having a gas burner (2) that has an electric motor (3) for its oxygenation. The gas burner (2) is fed by a pipe (4), of propane or natural gas, which permits the regulation of gas pressure for its adequate functioning. The gas burner (2) is oxygenated by an electric motor (3) supplied with energy produced by an electric plant (5), which also functions with gas. Electric plant (5) also generates energy for a control board and lights. The gas necessary for the operation of electric plant (5) comes from the same source as the gas burner's (2) supply source. The electric plant (5) has a generator that produces a 115 to 220 V output of alternating current and 12V of direct current.

The temperature system has a heating tank (6) that comprises three zones: and interior zone or smelting chamber (7), an intermediate zone (9) and an exterior zone (11). Solid tar arrives through a duct (18), coming from a spout tank (17). The tar is melted at a temperature which does not exceed 250° C. At the intermediate zone (9) is a burner's mouth (10) that enters the intermediate zone (9) in such a way that the flame crashes with an interior cylinder or interior zone (7), thereby generating a hot air whirlwind. At the exterior zone (11), defined by a protector shell made of highly resistant steel and the intermediate zone (9), is a temperature insulating material of light glass wool of uniform texture slightly softened with lubricant oil. On the exterior surface of the protector shell is a holding ring (12) that permits the fixture or union between the heating tank and the shell. The heating tank (6) also has a base (13). Internally, the base (13) presents a plurality of arms (14), over which a conical base of the smelting chamber (7) is attached. The smelting chamber of internal heating zone (7), also has a lid (15) made of steel with a neoprene pack that avoids a loss of pressure and temperature. Installed on an exterior surface of the lid (15) are conventional elements such as a security valve (16C), pressure gauge and check valve (16). All of the elements are connected to a compressor (16A) and thermocouple. The lid (15) is adjusted through a plurality of screws, thus enabling airtight closing.

The supply tank (17) has an intermediate zone (17A) and a temperature insulator (17B). Supply tank (17) is connected to the heating tank (6) through a hose (18), which is incorporated to a revolving pump (19) which suctions a regular and constant supply of tar. The supply tank (17) has a lid preferably held by eight screws, which has an "O" ring preventing the escape of gases to the outside. The lid also presents a security valve and a check for the connection of a hose to a cistern (tank) car. The cistern (tank) car is used in cases of extensive zones waterproofing. The cistern car also consists of a cylindrical tank with a temperature insulating system and a hot oil chamber.

A vent (8) transports the hot air from the intermediate zone (9) of the heating tank (6) to the intermediate zone (17A) of the supply tank (17), thereby enabling the easy passage of tar to the principal heating tank (6). Connected to the intermediate zone (9) of the heating tank (6) is a hose (20A) which is connected to a intermediate part of a hose (20). Hose (20) is comprised of two zones, one interior zone that receives the tar and one intermediate zone which receives the heat, thereby enabling the passage of liquid tar through the sprayer hose (20) up to a spraygun (21). Spraygun (21) has two entries, (21A) and (21B), equipped with their respective fittings, for the income of hot air and tar, respectively.

What is claimed is:

1. A tar heating and spraying apparatus comprising:

a gas burner;

a pipe that supplies a fuel gas to said gas burner;

an electric motor that supplies a source of oxygen to said burner;

an electric plant that provides energy to said electric motor and a control board, said electric plant being powered by said fuel gas;

a heating tank heated by said gas burner and comprising an interior zone, an intermediate zone and an exterior zone;

a supply tank that hold dense tar;

a duct that connects said supply tank to said heating tank;

a hose connecting said supply tank to said heating tank;

an in line pump in cooperation with said hose;

a lid covering a top opening in said supply tank; said supply tank having an intermediate zone and a hose connection to which a hose can be connected;

a vent connecting said intermediate zone of said supply tank to said intermediate zone of said heating tank, said vent capable of transporting hot air from said intermediate zone of said heating tank to said intermediate zone of said supply tank which enables easy passage of tar;

a sprayer gun having a first entry and a second entry; and a further hose connecting said intermediate zone of said heating tank to said sprayer gun, said further hose having an interior passageway through which the tar travels and having an outer passageway through which hot gases travel, said first entry of said sprayer gun in communication with said outer passageway of said further hose and receiving hot air and said second entry of said sprayer gun in communication with said interior passageway of said further hose and receiving tar.

2. A tar heating and spraying apparatus comprising:

a gas burner;

a pipe that supplies a fuel gas to said gas burner;

an electric motor that supplies a source of oxygen to said burner;

an electric plant that provides energy to said electric motor and a control board, said electric plant being powered by said fuel gas;

a heating tank heated by said gas burner and comprising an interior zone, an intermediate zone and an exterior zone;

a supply tank that hold dense tar;

a duct that connects said supply tank to said heating tank;

a temperature insulation located between said intermediate zone of said heating tank and said exterior zone of said heating tank;

said exterior zone of said heating tank being defined by a protective shell of said heating tank;

said heating tank having a conical base;

a holding ring located on the outside of said protective shell and connecting said protective shell to said heating tank;

a support base having a plurality of arms which support said conical base of said heating tank;

a lid for covering said heating tank opening; and a compressor connected though a check valve to said heating tank, said compressor providing a compressed fluid to the top of said heating tank.

* * * * *